United States Patent [19]

Severijns et al.

[11] 4,213,311

[45] Jul. 22, 1980

[54] SUPERLEAK

[75] Inventors: Adrianus P. Severijns; Frans A. Staas, both of Eindhoven, Netherlands

[73] Assignee: U.S. Philips Corporation, New York, N.Y.

[21] Appl. No.: 960,370

[22] Filed: Nov. 13, 1978

[30] Foreign Application Priority Data

Dec. 16, 1977 [NL] Netherlands ..... 7713951

[51] Int. Cl.[2] ..... F25B 19/00

[52] U.S. Cl. ..... 62/514 R

[58] Field of Search ..... 62/467, 514 R

[56] References Cited

U.S. PATENT DOCUMENTS

| | | | |
|---|---|---|---|
| 3,835,662 | 9/1974 | Staas et al. | 62/467 |
| 3,896,630 | 7/1975 | Severijns et al. | 62/514 R |
| 3,978,682 | 9/1976 | Severijns et al. | 62/514 R |
| 4,030,900 | 6/1977 | Van Litsenburg | 62/514 R |
| 4,136,531 | 1/1979 | Staas et al. | 62/514 R |
| 4,155,371 | 1/1979 | Kesselring et al. | 62/514 R |

*Primary Examiner*—Ronald C. Capossela

*Attorney, Agent, or Firm*—Thomas A. Briody; William J. Streeter; Rolf E. Schneider

[57] ABSTRACT

A superleak in which a heat exchanger having a superleak structure is included in order to drastically reduce heat leak in the flow direction during operation.

4 Claims, 4 Drawing Figures

SUPERLEAK

This invention relates to a superleak which comprises, accommodated in a duct, a filler mass which consists of a material of low heat conductivity and through which superfluid $^4$He can flow, said superleak including at least one heat exchanger which is accommodated in a housing and which contains a filler material of high heat conductivity, at least in directions transversely of the flow direction.

A superleak of the described kind is known from U.S. Pat. No. 3,835,662.

The superleak therein forms part of a $^4$He circulation system in a $^3$He–$^4$He dilution refrigerator. By means of a fountain pump, superfluid $^4$He is extracted from the evaporation reservoir of the machine and is injected into an upper chamber of two interconnected mixing chambers. The superfluid reaches the evaporation reservoir again via the lower mixing chamber.

Heat is dissipated via the heat exchangers included in the superleak. This is necessary because a heat leak exists in the direction from the evaporation reservoir of higher temperature level to the upper mixing chamber of lower temperature level; there are two causes for this leak. First of all, some heat transport always occurs through the superleak material of low heat conductivity (duct wall and filler material). Secondly, the superleak is not perfect in the sense that some $^3$He and normal $^4$He can always pass the superleak. Contrary to superfluid $^4$He, not carrying entropy, the $^3$He and the normal $^4$He constitute heat carriers.

Superleaks containing a filler mass of a material of low heat conductivity can be realised by using the available materials which have the desired very small diameters for the pores in the filler mass (pore diameter, for example, $10^{-6}$ cm).

However, these criteria do not apply for the heat exchanger.

The filler materials of high heat conductivity available for the heat exchanger do not allow an adequate number of such small pores to be realised per unit of surface area.

Fine pulverized metals of high heat conductivity have, for example, a grain size on the order of 10 to 100 microns, whilst a grain size of 0.03 micron or less is required in order to achieve pores having a diameter on the order of magnitude of $10^{-6}$ cm.

In practice, this means that the heat exchanger comprises a number of passage openings which is smaller than that of the actual superleak, but the diameter thereof is larger.

The wider ducts in the heat exchanger cause a turbulence in the superfluid $^4$He flowing therethrough, said turbulence being accompanied by friction losses, so that part of the superfluid $^4$He changes over into normal $^4$He. The conversion of this normal $^4$He into superfluid $^4$He again requires additional cooling power.

The present invention has for its object to provide an improved superleak of the described kind, in which the heat leak from higher to lower temperature level is substantially reduced.

In order to realise this object, the superleak in accordance with the invention is characterized in that the housing also contains superleak filler material which is combined with the heat exchanger filler material so as to form an integral filler mass having a superleak structure and having the same or substantially the same effective flow cross-sectional area as the superleak filler mass in the duct, the heat conductivity in directions transversely of the flow direction being maintained.

The described integrated combination of the heat exchanger and superleak components provides an assembly having pore diameters which correspond to those of the actual superleak. Because, moreover, the effective flow cross-sectional areas of superleak filler mass and integral filler mass are attuned to each other (the "coarse" heat exchanger filler material causes the circumferential diameter of the integral filler mass to be larger than that of the superleak filler mass), it is achieved that the described friction losses are substantially prevented, whilst the favourable transfer of heat is maintained.

A direct transition from superleak filler mass having a comparatively small circumferential diameter to the integral filler mass having a comparatively large circumferential diameter may give rise to dissipation losses due to the transition from comparatively large flow cross-sectional area to comparatively small flow cross-sectional area at the interface between the two filler masses.

In order to avoid such losses, a preferred embodiment of the superleak in accordance with the invention is characterized in that a transition layer of superleak filler mass which serves to bridge a difference in circumferential diameter of the two filler masses is provided between the integral filler mass in the housing and the superleak filler mass in the duct, on both sides of the integral filler mass.

Thus, a more gradual transition from the pores in the superleak filler mass (comparatively large number of pores per unit of surface area) to the pores in the integral filler mass of the housing (comparatively small number of pores per unit of surface area) is realised.

A further preferred embodiment of the superleak in accordance with the invention is characterized in that the integral filler mass consists of a powder mixture of at least one metal oxide of low heat conductivity, such as iron oxide or aluminium oxide, and at least one metal of high heat conductivity, such as copper or silver.

Another embodiment of the superleak in accordance with the invention is characterized in that the integral filler mass is formed by a number of metal layers of high heat conductivity, extending transversely of the flow direction and provided with openings, such as gauzes or perforated foils of copper or phosphor bronze, arranged inside a powder mass of at least one metal oxide of low heat conductivity, such as iron oxide or aluminium oxide.

The invention will now be described in detail with reference to the accompanying drawing, in which.

Figure 1:
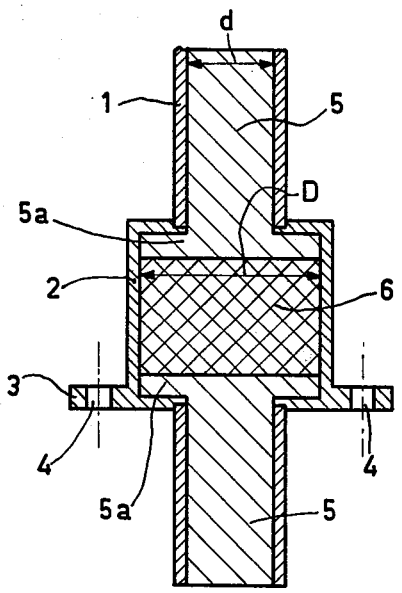
FIGS. 1 and 2 are longitudinal sectional views of two embodiments of the superleak.

The superleak shown in FIG. 1 comprises a duct 1 of a material of low heat conductivity, for example stainless steel, a housing 2 of a material of high heat conductivity, for example, copper, which is provided with a flange 3 with openings 4, a superleak filler mass 5 and an integral heat exchanger/superleak filler mass 6.

The superleak filler mass 5 consists of, for example, iron oxide powder having a grain size of, for example, 0.03 micron. The heat conductivity of iron oxide is low. The integral filler mass 6 consists of, for example, a mixture of said iron oxide powder and copper powder (grain size 40–80 microns), the copper amounting to, for example, from 30 to 70 percent by volume. The integral filler mass 6 thus has a superleak structure, i.e. pores of the same dimensions as the superleak filler mass 5 whilst during operation the copper powder ensures that the heat taken up from the helium flowing therethrough is dissipated to the housing wall 2. By means of the flange 3 with the openings 4, the housing 2 can be thermally anchored to a source of cold which cools the housing 2.

The circumferential diameter D of the integral filler mass 6 is larger than the circumferential diameter d of the superleak filler mass 5, because the effective flow cross-sectional areas for helium are equal for both filler masses. This is because, due to the comparatively coarse copper grains, the number of pores per unit of surface area is smaller in the integral filler mass 6 than in the superleak filler mass 5.

The superleak filler mass 5 adjoins the integral filler mass 6 via transition sections 5*a*.

Figure 2:
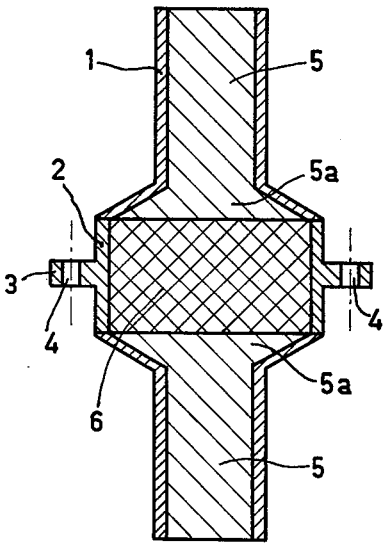

The superleak shown in FIG. 2 is roughly similar to that of FIG. 1. The same reference numerals have been used for corresponding parts. In the present case, the superleak transition sections 5*a* are constructed to be conical and the flange 3 is situated halfway of the housing 2.

Figure 3:
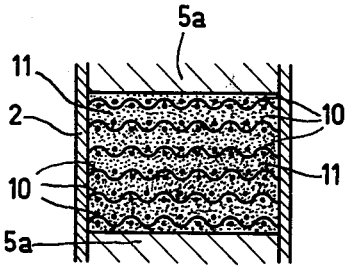
FIGS. 3 and 4 are longitudinal sectional views of embodiments of integral heat exchanger/superleak filler masses.

FIG. 3 shows an integral filler mass which comprises a number of gauze layers 10 of, for example, copper, which are arranged transversely of the flow direction and which are secured to the housing 2. These gauze layers (wire diameter, for example, between 50 and 100 microns; mesh size, for example, between 100 and 200 microns) provide for the transport of heat, taken up from helium flowing therethrough, to the housing wall 2 where this heat can be transported further.

The gauze layers 10 are arranged in a powder mass 11 of, for example, iron oxide or aluminium oxide (grain size, for example, 0.03 micron).

Figure 4:
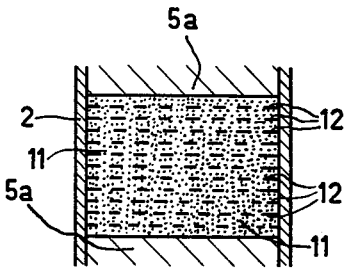

The integral filler mass shown in FIG. 4 differs from that shown in FIG. 3 in that the gauze layers are replaced by perforated foils 12, for example, copper foils (thickness, for example, 25 microns; diameter of the perforations, for example, 50 microns).

What is claimed is

1. A superleak which comprises a duct, a filler mass of low heat conductivity in said duct, said filler mass being capable of passing superfluid $^4$He, a housing formed in said duct at an intermediate location thereof, and an integral filler mass of higher heat conductivity in said housing, said integral filler mass effecting heat transfer in a direction transverse to the $^4$He flow direction, said integral filler mass being a mixture of a low heat-conductivity filler material and a higher heat-conductivity filler material and having the same or substantially the same effective cross-sectional flow area as the filler mass in the duct.

2. A superleak according to claim 1, in which the cross-sectional area of the housing is greater than that of the duct, and which includes on each side of the integral filler mass a transition layer of filler mass bridging the difference in cross-sectional area between the integral filler mass in the housing and the filler mass in the duct.

3. A superleak according to claim 1 or 2, in which the integral filler mass comprises a powdered mixture of at least one low heat-conductivity metal oxide selected from the group consisting of iron oxide and aluminium oxide and at least one high heat-conductivity metal selected from the group consisting of copper and silver.

4. A superleak according to claim 1 or 2, in which the integral filler mass comprises a plurality of foraminous layers of a high heat-conductivity metal selected from the group consisting of copper and phosphor bronze, said layers extending transversely to the $^4$He flow direction and being arranged within a powdered mass of at least one low heat-conductivity metal oxide selected from the group consisting of iron oxide and aluminium oxide.

* * * * *